United States Patent [19]

Tschida, Sr.

[11] 4,405,062

[45] Sep. 20, 1983

[54] TUBE DISPENSING DEVICE

[76] Inventor: Eraine J. Tschida, Sr., 3915 Buckley Pl., Missoula, Mont. 59801

[21] Appl. No.: 312,655

[22] Filed: Oct. 19, 1981

[51] Int. Cl.[3] ..... B65D 35/28

[52] U.S. Cl. ..... 222/102; 222/103

[58] Field of Search ..... 222/102, 103, 97, 105, 222/106, 96

[56] References Cited

U.S. PATENT DOCUMENTS 2,491,161 12/1949 Campbell ..... 222/103

*Primary Examiner*—Stanley H. Tollberg

*Attorney, Agent, or Firm*—Michael E. Kiteck, Jr.

[57] ABSTRACT

A flexible tube dispensing device designed for use with flexible tubes containing pastes, gels, liquids and certain powders. In use the dispensing device opens to accommodate the end of a flexible tube in which is contained a product in paste or other form which may be dispensed by squeezing the tube. Once the tube is inserted, squeezing of a pair of dispensing jaws of the device squeezes the tube to dispense the product and causes the device to advance along the tube as the product is dispensed. This allows almost complete evacuation of the tube contents and dispensing of relatively uniform amounts of contents each time the device is squeezed.

6 Claims, 4 Drawing Figures

FIG 1
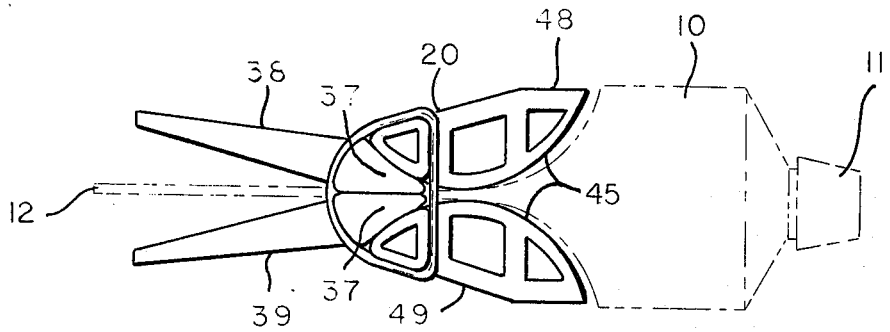
FIG 2
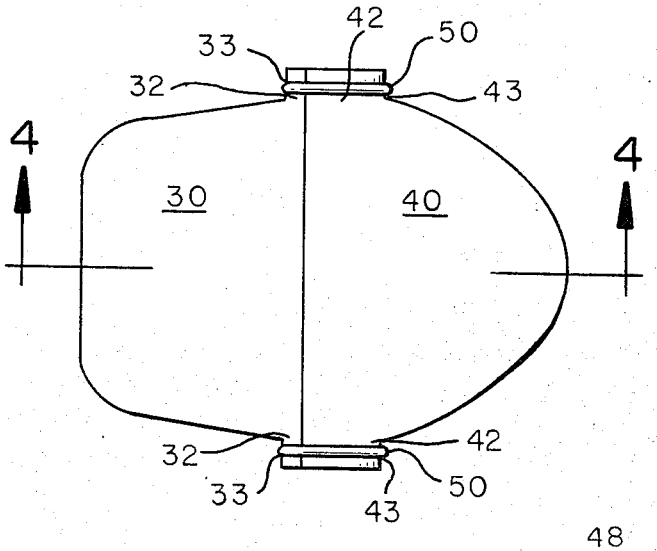
FIG 3
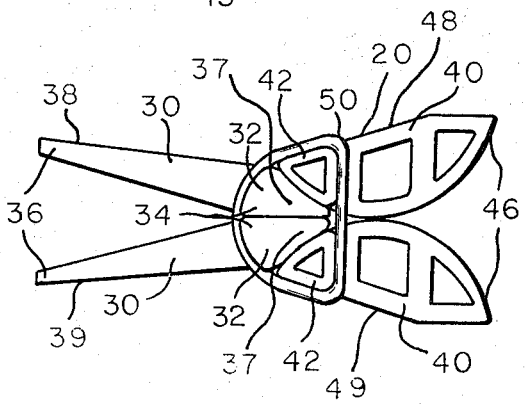
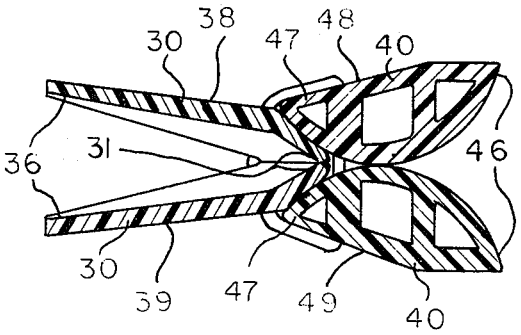
FIG 4

TUBE DISPENSING DEVICE

BACKGROUND OF THE INVENTION

Numerous paste, gel, viscous fluids and some slippery powders are packaged in flexible tubes of metal, plastic or other material. Common examples are toothpaste, caulking materials, artist's paints, automotive greases, cosmetics and medical ointments.

Metal tubes hold the various bumps and wrinkles caused by manual squeezing so that it is difficult to completely evacuate the contents resulting in large amounts of waste. Plastic tubes are resilient and tend to spring back so that complete evacuation of contents is difficult.

Over the years keys have been used for winding metal tubes but these do not work well for plastic tubes. Wall mounted roller devices have been employed but these are clumsy and expensive.

Recently others have invented structures designed for portable application in dispensing products from tubes. Examples are U.S. Pat. No. 4,030,636 to Drancourt and No. 4,159,787 to Wright. The Drancourt device employs a roller and ratchet mechanism while the Wright device is slid along the tube. The ratchet mechanism is fairly complex and expensive while the sliding device does not hold its advance along the tube but must be slid manually. In addition, the sliding device does not apply sufficient pressure to completely dispense the tube contents.

It is accordingly desirable that a dispensing device for tube packages be provided in the way of a portable accessory that is simple, inexpensive, simple to use and providing fairly complete tube contents evacuation.

SUMMARY OF THE INVENTION

A primary object of the present invention is to provide a portable dispensing device for use with tube-type packages which may conveniently and easily be attached to the tube for dispensing the contents.

Another object of the invention is to provide a portable dispensing device for use with a tube which automatically grips the tube and advances along it when dispensing the contents.

Still another object of the invention is to provide a portable dispensing device for use with a tube which is durable, economical to manufacture and relatively easy to operate and keep clean.

Yet another object of the invention is to provide a portable dispensing device for use with a tube which will dispense nearly all of the contents so as to reduce waste.

A further object of the invention is to provide a portable dispensing device for use with a tube which will dispense relatively uniform amounts of contents with each manual activation of the device.

With these and other objects in view the invention broadly comprises a portable dispensing device for evacuating the contents of a tube-type package having a pair of opening levers to allow insertion of a tube into the device, a pair of dispensing jaws which grip the tube and when actuated advance along the tube dispensing a portion of tube contents, and resilient means for holding the jaws and levers in their relative positions. In addition, the resilient means provide force to hold the dispensing jaws together to grip the tube and expel a portion of the contents in use.

BRIEF DESCRIPTION OF THE DRAWINGS

In the drawings:

FIG. 1 is a side elevation of the dispensing device in use showing a tube in phantom inserted into the device with part of the contents dispensed.

FIG. 2 is a top view of the dispensing device.

FIG. 3 is a side elevation of the dispensing device.

FIG. 4 is a vertical section through the device taken on line 4—4 of FIG. 2.

DESCRIPTION OF THE PREFERRED EMBODIMENT

Referring now more particularly to the drawings reference numerals will be used to denote like parts or structural features in the different views. In FIG. 1 the numeral 10 denotes generally a tube with a cap 11 and a crimped end 12. The tube dispensing device itself forming the subject of the present invention is designated generally by the numeral 20. FIG. 1 shows the tube 10 inserted into the dispensing device 20 in proper orientation for use. The tube 10 is fed crimped end 12 first into the front end of the dispensing device 20. The front end of the device is shown at the right side of the drawings.

FIG. 3 shows the elements of the dispensing device 20 in side elevation. A pair of opening levers 30 and a pair of dispensing jaws 40 are held in position by resilient means 50 which in the preferred embodiment are bands of an elastic material although springs may also be used. The upper lever 38 and lower lever 39 are identical. The lower lever 39 is oriented upside down from and below the upper lever 38.

Opening levers 30 have sideward projections 32 wutg grooves 33, as shown in FIG. 2, to hold resilient securing means 50. In addition, the sideward projections 32 on opening levers 30 also project inwardly toward one another to form lever pivots 34. That is to say the upper lever 38 has lever pivots 34 projecting downwardly from its lower side and lower lever 39 has lever pivots 34 projecting upwardly from its upper side. Since the lower lever 39 is directly below the upper lever 38, the lever pivots 34 on the two levers 30 bear together. In this orientation pressure on the rearward ends 36 of levers 30 will cause the levers 30 to pivot about pivots 34, so the front ends 37 of levers 30 open.

As shown in FIG. 4, the upper opening lever 38 also has a downwardly protruding raised ridge 31 at the front end 37. Similarly, the lower opening lever 39 has a matching upwardly protruding raised ridge 31 at the front end 37. When the rearward ends 36 of opening levers 30 are pressed together, opening levers 30 pivot at lever pivots 34 so the raised ridges 31 at front ends 37 of levers 30 open. Resilient means 50 hold the dispensing jaws 40 to the opening levers 30 so that the dispensing jaws 40 also open allowing insertion of a tube 10 as shown in FIG. 1. When opening levers 30 are released, the raised ridges 31 come together to grip the end of tube 10.

Dispensing jaws 40 are shown in FIG. 4 in the form of fractional rollers. Upper jaw 48 has a curved surface 45 on its lower side which is curved about an axis above upper jaw 48 so that if the curved surface were continued it would form a cylinder about the axis. Other generally oval shapes besides a circular cylinder could also be used with good effect. Lower jaw 49 is identical to upper jaw 48 except that it is inverted and placed below upper jaw 48. Together the two jaws provide the same roller action to squeeze tube 10 as would two whole rollers, but by employing only a portion of a complete roller, a more compact construction results. The upper and lower fractional rollers comprising dispensing jaws 40 are shown in FIGS. 1, 3 and 4 as hollowed out for lighter weight, a construction suitable for injection molded plastic, but solid members and other materials could be employed within the spirit of the invention.

Dispensing jaws 40 have sideward projections 42 with grooves 43 as may be seen in FIGS. 2 and 3. Grooves 43 and grooves 33 are oriented so as to form a continuous groove at each side of the assembled dispensing device 20 so as to hold resilient securing means 50 in the groove so formed. Resilient means 50 then holds the opening levers 30 and dispensing jaws 40 in the assembled positions. The grooves 43 in dispensing jaws 40 may be eliminated so that resilient means 50 is held solely by the grooves 33 in opening levers 30. In the preferred embodiment the resilient means 50 is a resilient elastic band shaped to fit the grooves 43. In an alternative embodiment the resilient means 50 is a resilient spring which may be in the form of a band or in several sections attached to the jaws 40 and levers 30 so as to hold them in the desired relative locations.

A tube 10 inserted into the dispensing device 20 as described above may be opened at the cap end to allow one to dispense the contents. This is accomplished by pressing inwardly on the front ends 46 of dispensing jaws 40. As the front ends 46 come together, dispensing jaws 40 squeeze on the tube dispensing a portion of the contents. The amount dispensed may be varied by how far the dispensing jaws 40 are pressed. In addition, the geometry of dispensing jaws 40 may be varied to allow a greater or lesser portion to be dispensed. This is accomplished by varying radius at the rearward ends 47 of dispensing jaws 40.

As the dispensing jaws 40 are pressed together, there is more pressure on the tube 10 from the dispensing jaws 40 than from the opening levers 30 so that the tube 10 is forced by the rotating action of dispensing jaws 40 toward opening levers 30. As dispensing jaws 40 are pressed together, the rearward ends 47 of dispensing jaws 40 open up stretching resilient means 50. The resilient means 50 then urges opening levers 30 toward dispensing jaws 40 by forward pressure on sideward projections 32 of opening levers 30. In this fashion the opening levers 30 advance along the tube. The front ends of opening levers 30 are generally wedge-shaped, the upper lever being tapered downward at the upper front portion and the lower lever tapering upward so that the wedge-shaped portion fits into the generally wedge-shaped opening at the rear of the fractional roller shaped dispensing jaws 40.

When the dispensing jaws 40 are released, their grip on the tube 10 weakens and raised ridges 31 on opening levers 30 hold it. As the released dispensing jaws 40 open at the front ends 46, they close at the rearward ends 47 while sliding along the tube 10 to an advanced position. In this fashion the dispensing device advances along the tube 10 as the contents are dispensed.

Dispensing jaws 40 are in the preferred embodiment longer at the center than at the sides so as to aid in guiding the contents out of the tube 10 without causing wrinkles in the tube 10 and to guide the dispensing device 20 straight along the tube 10.

A tube 10 may be squeezed manually and later the tube dispensing device 20 may be used to remove bumps by applying and actuating the device 20 a number of times to force the contents to the cap end of the tube 10. If the device 20 is actuated on a tube 10 which is capped, it will force the contents to the cap end and then slip on the surface of the tube 10 so that no further advance of the device 20 along the tube 10 occurs.

While I have shown and described an embodiment of this invention in some detail, it will be understood that this description and illustrations are offered merely by way of example, and that the invention is to be limited in scope only by the appended claims.

Having disclosed and described a preferred embodiment of the invention, what I claim to be new and desire to protect by U.S. Letters Patent is:

1. A tube dispensing device for use in manually emptying deformable tubes of the type containing soft paste comprising:

an upper fractional roller wider than the tube to be evacuated, with rounded side down, a lower fractional roller of similar width with rounded side up and located so that the upper rounded side contacts the rounded side of the upper fractional roller, an upper generally horizontal lever of width similar to that of fractional rollers having a raised ridge at the front end of the lower surface and having a generally wedge-shaped front end with the top surface tapering down to the lower front end and upper lever also having raised pivot points on the lower surface near the front end toward the sides, a lower generally horizontal lever of width similar to upper lever being located beneath the upper lever having a raised ridge at the front end of the upper surface so as to meet the ridge of the upper lever and having a generally wedge-shaped front and with the bottom surface tapering up to the upper front end and lower lever also having raised pivot points on the upper surface near the front end toward the sides so as to meet the pivot points of the upper lever, resilient securing means to hold the rearward ends of the fractional rollers and the forward ends of the levers in proximity, with the wedge portions of the levers fitting in the gap at the rearward end of the rollers, the upper and lower fractional rollers having adaptations at the rearward ends to receive the securing means and the upper and lower levers having adaptations at the forward ends to receive the securing means.

2. The subject matter of claim 1 wherein the adaptations are sideward projections.

3. The subject matter of claim 2 wherein the resilient securing means is a resilient band sized to fit over the sideward projections.

4. The subject matter of claim 2 wherein the resilient securing means is a resilient spring sized to fit over the sideward projections.

5. The subject matter of claim 3 wherein the projections on the levers are grooved to receive the resilient band.

6. The subject matter of claim 4 wherein the projections on the levers are grooved to receive the resilient band.

* * * * *